US008234110B2

(12) United States Patent
Meng et al.

(10) Patent No.: US 8,234,110 B2
(45) Date of Patent: Jul. 31, 2012

(54) VOICE CONVERSION METHOD AND SYSTEM

(75) Inventors: Fan Ping Meng, Beijing (CN); Yong Qin, Beijing (CN); Qin Shi, Beijing (CN); Zhi Wei Shuang, Beijing (CN)

(73) Assignee: Nuance Communications, Inc., Burlington, MA (US)

( * ) Notice: Subject to any disclaimer, the term of this patent is extended or adjusted under 35 U.S.C. 154(b) by 975 days.

(21) Appl. No.: 12/240,148

(22) Filed: Sep. 29, 2008

(65) Prior Publication Data

US 2009/0089063 A1 Apr. 2, 2009

(30) Foreign Application Priority Data

Sep. 29, 2007 (CN) ..... 2007 1 0163066

(51) Int. Cl.
*G10L 19/06* (2006.01)

(52) U.S. Cl. ..... 704/209

(58) Field of Classification Search ..... 704/205–209
See application file for complete search history.

(56) References Cited

U.S. PATENT DOCUMENTS 5,327,521 A * 7/1994 Savic et al. ..... 704/272
6,332,121 B1 12/2001 Kagoshima et al. ..... 704/262
6,336,092 B1 * 1/2002 Gibson et al. ..... 704/268
6,615,174 B1 9/2003 Arslan et al. ..... 704/270
6,980,665 B2 12/2005 Kates ..... 381/312
2005/0182629 A1 8/2005 Coorman et al. ..... 704/266

FOREIGN PATENT DOCUMENTS

WO WO 0178064 A1 * 10/2001

OTHER PUBLICATIONS

Tadashi Okubo et al., "Hybrid voice conversion of unit selection and generation using prosody dependent HMM", IEICE Trans. Inf. & Syst., vol. E89-D, No. 11, pp. 2775-2782 (Nov. 2006).
Masatsune Tamura et al., "Fast Concatenative Speech Synthesis Using Pre-Fused Speech Units Based on the Plural Unit Selection and Fusion Method", IEICE Trans. Inf. & Syst., vol. E90-D, No. 2, pp. 544-553 (Feb. 2007).
David Sundermann et al., "Text-Independent Voice Conversion Based on Unit Selection", pp. 1-4.
Levent M. Arslan et al., "Voice Conversion by Codebook Mapping of Line Spectral Frequencies and Excitation Spectrum", pp. 1-4.

* cited by examiner

*Primary Examiner* — Abul Azad
(74) *Attorney, Agent, or Firm* — Wolf, Greenfield & Sacks, P.C.

(57) ABSTRACT

A method, system and computer program product for voice conversion. The method includes performing speech analysis on the speech of a source speaker to achieve speech information; performing spectral conversion based on said speech information, to at least achieve a first spectrum similar to the speech of a target speaker; performing unit selection on the speech of said target speaker at least using said first spectrum as a target; replacing at least part of said first spectrum with the spectrum of the selected target speaker's speech unit; and performing speech reconstruction at least based on the replaced spectrum.

31 Claims, 3 Drawing Sheets

VOICE CONVERSION METHOD AND SYSTEM

CROSS-REFERENCE TO RELATED APPLICATIONS

This application claims priority under 35 U.S.C. §119 to Chinese Patent Application No. 200710163066.2 filed Sep. 29, 2007, the entire text of which is specifically incorporated by reference herein.

FIELD OF THE INVENTION

The present invention relates to a method and a system for voice processing, and in particular, to a method and a system for converting human speech.

BACKGROUND OF THE INVENTION

Voice conversion is a process to convert a source speaker's speech to sound like a target speaker's speech. There are currently many applications for voice conversion. An important application is to build customized text-to speech systems for different companies, in which a TTS system with one company's favorite speech can be created quickly and inexpensively by modifying the speech corpus of an original speaker. Voice conversion can also be used for generating special character speech and keeping a speaker's identity in speech-to speech-translation, and such converted speech can be used for a variety of applications, such as movie making, online games, voice chatting, and multimedia message services. To evaluate the performance of voice conversion systems, there are usually two criteria for the converted speech: quality of converted speech and similarity to the target speaker. With state-of-art voice conversion technologies, there is typically a tradeoff between quality and similarity. Additionally, different applications lay special emphasis on quality and similarity. Generally speaking, better speech quality is an important requirement for the practical application of voice conversion technologies.

Spectral conversion is a key component in voice conversion systems. The most popular two spectral conversion methods are codebook mapping (cf. Abe, M., S. Nakamura, K. Shikano, and H. Kuwabara, "Voice Conversion through Vector Quantization," Proc.ICASSP, Seattle, Wash., U.S.A., 1998, pp. 655-658) and Gaussian mixture model (GMM) conversion algorithm (cf. Stylianou, Y. et al., "Continuous Probabilistic Transform for Voice Conversion," IEEE Transactions on Speech and Audio Processing, V. 6, No. 2, March 1998, pp. 131-142; and Kain, A. B., "High Resolution Voice Transformation," Ph.D. thesis, Oregon Health and Science University, October 2001). However, although both two kinds of methods have been improved recently, the quality degradation introduced is still severe (cf. Shuang, Z. W., Z. X. Wang, Z. H. Ling, and R. H. Wang, "A Novel Voice Conversion System Based on Codebook Mapping with Phoneme-Tied Weighting," Proc. ICSLP, Jeju, Korea, 2004). In comparison, another spectral conversion method—frequency warping—introduces less quality degradation (cf. Eichner, M., M. Wolff, and R. Hoffmann, "Voice Characteristic Conversion for TTS Using Reverse VTLN," Pro. ICASSP, Montreal, PQ, Canda, 2004). Many works have been proposed on finding good frequency warping functions. For example, one approach was proposed by Eide, E. and H. Gish in "A Parametric Approach to Vocal Tract Length Normalization," ICASSP 1996, Atlanta, USA, 1996, in which the warping function is based on the median of the third formant for each speaker. Some researchers extended this approach by generating warping functions based on the formants belonging to the same phoneme. However, formant frequency and its relationship with vocal tract length (VTL) are highly dependent on not only the vocal shape of a speaker and different phoneme but also the context, and could vary largely with different context for the same speaker. The Chinese patent application with a publication number of CN101004911A, filed by the same applicant, discloses a novel solution of generating a frequency warping function by mapping formant parameters of the source speaker and the target speaker, in which alignment and selection process are added to ensure the selected mapping formants can represent speakers' voice difference well. This solution requires only a very small amount of training data for generating the warping function, which can greatly facilitate its application. It can also achieve high quality of the converted speech while successfully making the converted speech similar to the target speaker. Nevertheless, listeners can still clearly perceive the difference between the converted speech and the target speaker in the speech conversion using the above solution. Such difference is caused by the detailed spectral difference, and it cannot be solved by purely frequency warping.

In the voice processing technologies, there is another speech technology, namely text-to-speech (TTS) technology. The most popular TTS technology is called concatenative TTS, where a speech database of a corpus speaker needs to be recorded first and segments of speech data of the speaker are then concatenated by unit selection to synthesize new speech data. In many commercial TTS systems, the speech database contains hours of recording. The smallest concatenation segments, or units, can be syllables, phonemes, and even 10 ms' frame of speech data.

In a typical concatenative TTS system, the sequence of candidate segments listed together the prosodic targets generated by an estimation model drive a Viterbi beam search for the sequence of units which minimize the cost function. The search aims at selecting from the sequence of candidate units the unit sequence with the least cost function. The target cost can comprise a set of cost components, e.g. the $f_0$ cost, which measures how far the $f_0$ contour of the unit is from that of the target; the duration cost, which measures how far the duration of the unit is from that of the target; the energy cost, which measures how far the energy of the unit is from that of the target (this component is not employed during search). The transition cost can comprise two components, one of which captures spectral smoothness across unit joins and the other of which captures pitch smoothness across spectral joins. The spectral smoothness component of this transition cost can be based on the Euclidian distance between perceptually-modified Mel cepstral coefficients. The target cost components and the transition cost components will be added together using weights which can be tuned by hand. Usually, the synthesized speech can be perceived spoken by the corpus speaker because it is concatenated by the corpus speaker's speech units in fact. However, since it is very difficult to simulate the speech generation procedure of real human, the synthesized speech is usually perceived unnatural and dull. Therefore, although traditional TTS systems preserve speaker's identity, they lose the naturalness because of the imperfect target estimation.

It is seen that speech technologies in the part art all have inherent limitations. There is a need to provide a voice conversion system providing both higher fidelity of target speech and naturalness of human speech.

BRIEF SUMMARY OF THE INVENTION

To overcome the limitations of the prior art, the present invention proposes a novel voice conversion solution that has higher similarity of target speech and exhibits naturalness of human voice.

According to an aspect of the present invention, there is provided a voice conversion method. The method comprises following steps: speech analysis step of performing speech analysis on the speech of a source speaker to achieve speech information; spectral conversion step of performing spectral conversion based on the speech information, to at least achieve a first spectrum similar to the speech of a target speaker; unit selection step of performing unit selection on the speech of the target speaker at least using the first spectrum as a target; spectrum replacement step of replacing at least part of the first spectrum with the spectrum of the selected target speaker's speech unit; a speech reconstruction step of performing speech reconstruction at least based on the replaced spectrum.

According to another aspect of the present invention, there is provided a voice conversion system. The system comprises: speech analysis means for performing speech analysis on the speech of a source speaker to achieve speech information; spectral conversion means for performing spectral conversion based on the speech information, to at least achieve a first spectrum similar to the speech of a target speaker; unit selection means for performing unit selection on the speech of the target speaker at least using the first spectrum as a target; spectrum replacement means for replacing at least part of the first spectrum with the spectrum of the selected target speaker's speech unit; speech reconstruction means for performing speech reconstruction at least based on the replaced spectrum.

According to a further aspect of the present invention, there is provided a computer program product including program code for, when executed on a computer device, implementing a voice conversion method according to the present invention.

The voice conversion solution according to the present invention combines spectral conversion technologies, such as frequency warping, and unit selection of TTS systems, and thus reduces the difference between the converted speech and the target speaker caused by the detailed spectral difference between speakers' speech. Moreover, since the converted source speech is used as the target of unit selection in the present invention, the finally converted speech not only has good similarity to the target speaker's speech but also keeps naturalness of human speech.

Other features and advantages of the present invention will become more apparent from the following detailed description of embodiments of the present invention, when taken in conjunction with the accompanying drawings.

BRIEF DESCRIPTION OF THE SEVERAL VIEWS OF THE DRAWINGS

In order to illustrate in detail features and advantages of embodiments of the present invention, reference will be made to the accompanying drawings. If possible, like or similar reference numerals designate the same or similar components throughout the figures thereof and description, in which.

DETAILED DESCRIPTION OF THE INVENTION

As discussed above, even if frequency warping is applied on source speech with a good-performance frequency warping function, listeners can still perceive the difference between the converted speech and the target speaker due to the detailed spectral difference between speakers' speech. Since pure spectral conversion such as frequency warping can hardly improve the similarity to the target speaker, the present invention proposes a composite voice conversion system, in which spectral conversion technologies such as frequency warping and unit selection of TTS systems are combined to achieve a better voice conversion system.

Figure 1:
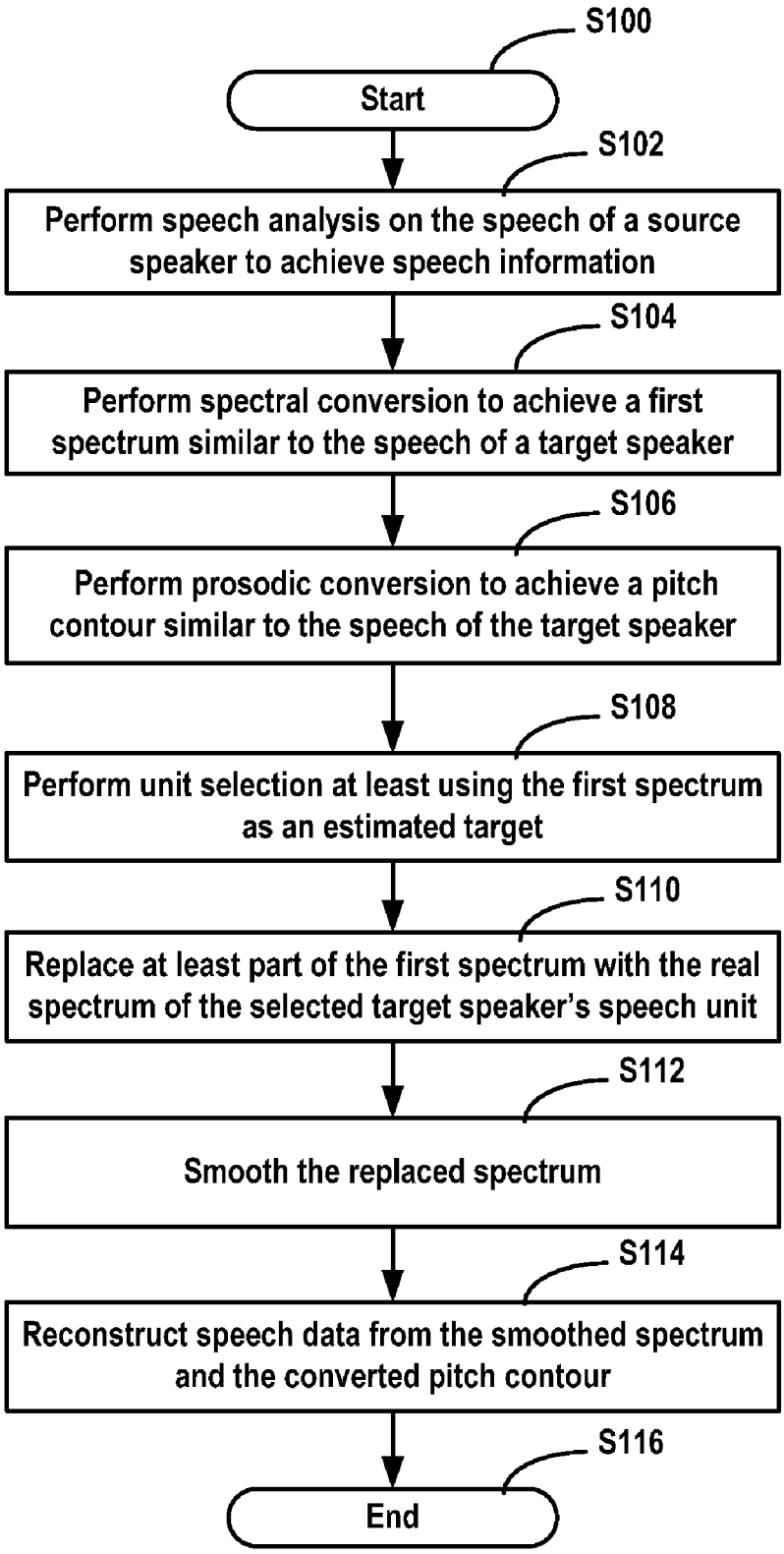
FIG. 1 shows a processing flowchart of a voice conversion method according to an embodiment of the present invention.

FIG. 1 shows a flowchart of a voice conversion method according to an embodiment of the present invention.

As shown in FIG. 1, the flow of this method starts in step S100.

In step S102, speech analysis is performed on the speech of a source speaker to achieve speech information, such as spectrum envelope and fundamental frequency contour information.

In step S104, according to the principles of a voice conversion system of the present invention, spectral conversion such as frequency warping is applied on the speech of the source speaker to obtain a first spectrum similar to the speech of a target speaker.

This step is quite straightforward by using a frequency warping function to convert the spectrum envelope. Suppose one frame of the source speaker's spectrum is S(w), and the frequency warping function from the target frequency axis to the source frequency axis is F(w), then the converted spectrum Conv(w) is:

$$\mathrm{Conv}(w)=S(F(w))$$

In step S106, prosodic conversion is performed on pitch contour (prosodic), mainly including fundamental frequency ($f_0$) contour conversion. For example, the average and variance of $f_0$ are converted by the trained $f_0$ pitch domain conversion function.

Those skilled in the art will appreciate that with frequency warping, the spectral-envelope equalization filter can be applied on the warped spectrum to compensate for the different energy distribution along the frequency axis.

After steps S104 and S106, the converted first spectrum is similar to that target speaker's spectrum, and preferably, the converted pitch contour is similar to that target speaker's pitch contour.

In step S108, unit selection is made on the target speaker's corpus at least using the first spectrum as the estimated target.

The smallest unit that can be used here is spectrum and fundamental frequency information extracted from one frame of speech. It is used as one code word, and the set of all code words is named codebook. For example, the frame length of the one frame of speech as used can be 5 ms or 10 ms. Those skilled in the art can adopt other speech lengths, which does not form any restriction on the present invention.

Preferably, the first spectrum converted in the frequency warping and the converted $f_0$ contour are used as the estimated target to select proper code words from the target speaker's codebook.

This step is similar to selection of candidate unit in a concatenative text-to-speech system. However, the difference is that the present invention uses the converted first spectrum and the converted $f_0$ contour as the target of the unit selection. The advantage is that such an estimated target is much more natural than that estimated by a prosody model and other models in TTS systems.

A set of target code words can be generated from the converted first spectrogram and the converted $f_0$ contour. If there is segmentation information of original speech, then target code words can simultaneously extract phonetic information. Then, the target cost function between the target code word and the candidate code word can be defined. Preferably, this target cost can be a weighted sum of spectral distance, prosodic distance and phonetic distance.

The spectral distance can be calculated through various distance between various spectral features, such as a Euclidean distance, the FFT (Fast Fourier Transform) amplitude spectrums, FFT reciprocal space amplitude spectrums, MFCC (Mel-scale Frequency Cepstral Coefficient), LPC (Linear Predictive Coding), or LSF (Linear Spectral Frequency), or simply use the weighted sum of various distances.

The prosodic distance can be calculated through the difference between $f_0$ in linear domain or in log domain. The prosodic distance can also be calculated by a predefined special strategy. For example, if both $f_0$ values are non-zero values or zero, their prosodic distance is zero. Otherwise, their prosodic distance is a very large value. Many other strategies can also be used, for example taking account of the difference between differential $f_0$ coefficients.

The phonetic distance between the target code word and the candidate code word can be calculated if the phonetic information is extracted during the generation of the target code word and the training of the candidate code word. One of the most important phonetic information is that which phoneme that the code word belongs to and its neighboring phonemes. A distance calculation strategy can be: if two code words belong to the same phoneme and have the same neighboring phonemes, their distance is zero. If two code words belong to the same phoneme but have different neighboring phonemes, their distance is set to a small value. However if two code words belong to different phoneme, their distance will be set to a large value.

Besides the target cost, the transition cost between two candidate code words further needs to be defined. This transition cost can be a weighted sum of spectral distance, prosodic distance and phonetic distance, which is similar to the target cost.

Thus, the set of code words in the target speaker's corpus which match the converted first spectrum and the $f_0$ contour most can be determined through the selection procedure.

In step S110, at least one part of the first spectrum is replaced with the real spectrum of the selected speech unit of the target speaker.

It is mainly because the target speaker's speech is selected in a basic unit such as frame, thus it is likely to raise a discontinuity problem in the ultimately obtained speech if the whole spectrum corresponding to this unit in the first spectrum is replaced with the selected unit directly. Since the low frequency part of spectrum is very essential to the continuity and not so important for improving the similarity to target, the low frequency part of spectrum corresponding to the selected unit in the first spectrum is kept unchanged according to a preferred solution of the present invention. That is, after the appropriate code word is selected, a part of the first spectrum higher than a specific frequency is replaced with the corresponding spectrum of the selected code word and the part lower than the specific frequency of the first spectrum is kept unchanged. According to a preferred implementation solution of the present invention, the specific frequency is selected from 500 Hz to 2000 Hz.

Preferably, in step S112, the spectrum obtained from the replacement is smoothed using any known solution in the prior art.

In step S114, the speech data is reconstructed from the smoothed spectrum and the converted $f_0$ contour.

Finally, the flow of this method ends in step S116.

The above-described voice conversion method according to an embodiment of the present invention incorporates a unit selection step and a spectrum replacement into the conventional spectral conversion-based voice conversion method, whereby selects from the target speaker's corpus a unit such as a speech frame by using the spectral-converted spectrum of the source speaker's speech as the estimated target and then replaces a corresponding part of spectrum. In this manner, it is able to take advantage of natural spectral features of the source speaker and preserve phonatory characteristics of the target speaker to a great extent.

In the aforesaid embodiment of a voice conversion method, frequency warping is used as an exemplary technical solution of spectral conversion. This is because the existing frequency warping solution can provide relatively high similarity between the converted speech and the target speaker's speech. However, this example is not restrictive, and those skilled in the art will appreciate that a technical solution according to the present invention can be carried out provided the frequency conversion step can provide a good estimated target for the subsequent unit selection step. Likewise, the $f_0$ contour conversion in the prosodic conversion can be implemented by other known technologies besides the pitch domain conversion.

Figure 2:
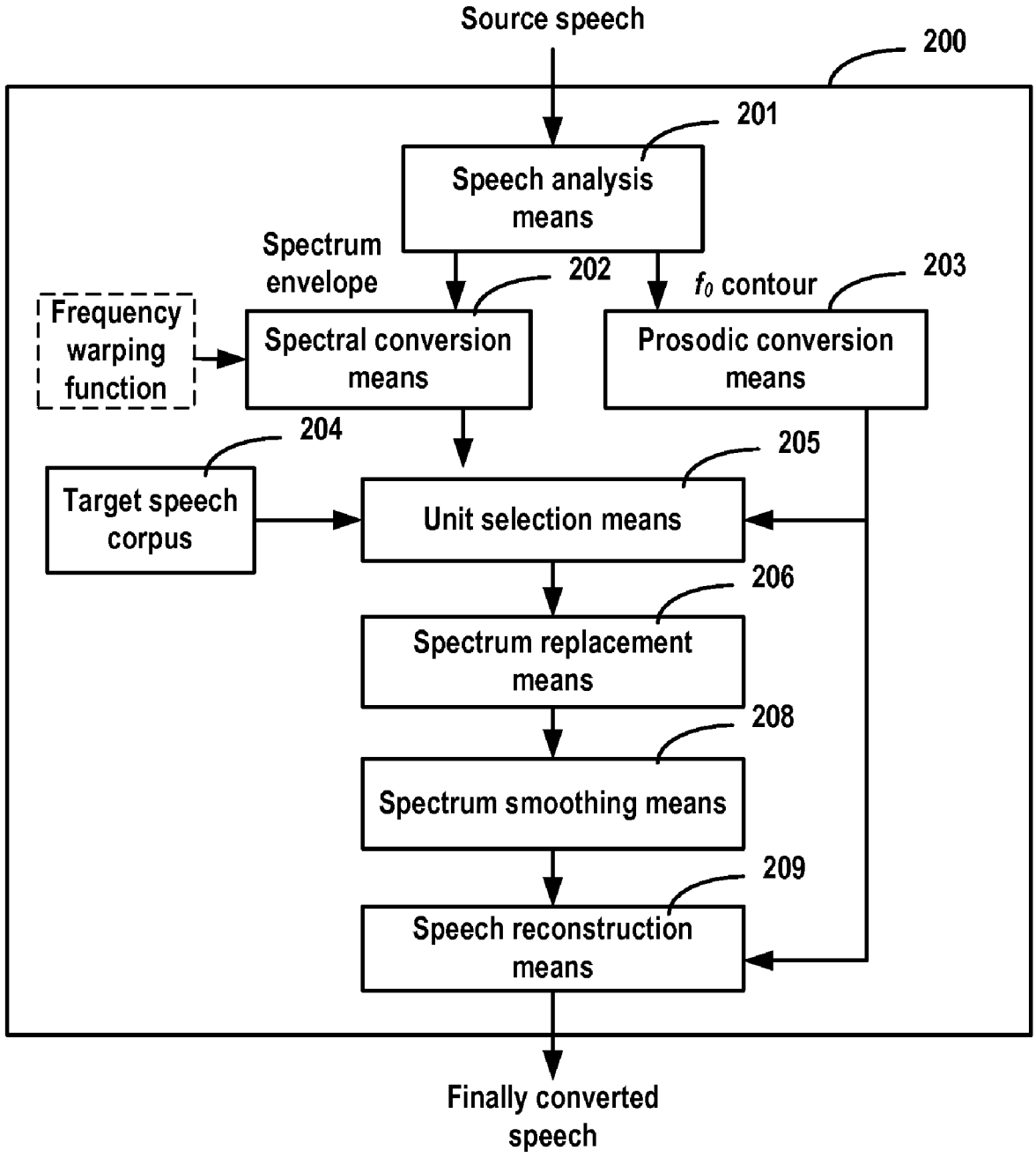
FIG. 2 schematically shows a voice conversion system according to an embodiment of the present invention.

FIG. 2 schematically shows a functional block diagram of a voice conversion system according to an embodiment of the present invention. In this figure, reference numeral 200 denotes a voice conversion system according to an embodiment of the present invention; 201 denotes speech analysis means that analyzes the source speech; 202 denotes spectral conversion means that performs spectral conversion on the spectrum envelope of the source speech, wherein spectral conversion means 202 performs spectral conversion using frequency warping technologies in the present embodiment; 203 denotes means that performs prosodic conversion on the source speech's contour; 204 denotes a target speech corpus that provides a codebook of the target speaker's speech; 205 denotes unit selection means that selects from the target speech corpus an appropriate code word unit; 206 denotes spectrum replacement means; 208 denotes spectrum smoothing means according to a preferred solution of the present invention; and 209 denotes speech reconstruction means that performs speech reconstruction to achieve the ultimately converted speech.

Similar to a conventional voice conversion system, the voice conversion system as shown in FIG. 2 performs speech analysis on the source speech to decompose the source speech into spectrum envelope and excitation (e.g. $f_0$ contour) in speech analysis means 201, and finally reconstructs the converted speech from the converted spectrum envelope and excitation in speech reconstruction means 209. For example, the voice conversion system 200 may use the speech analysis/reconstruction technique, proposed by Chazan, D., R. Horny, A. Sagi, S. Shechtman, A. Sorin, Z. W. Shuang, and R. Bakis in "High Quality Sinusoidal Modeling of Wideband Speech for the Purposes of Speech Synthesis and Modification" in ICASSP 2006, to get an enhanced complex envelope model and pitch contour. The technique is based on efficient line spectrum extraction and frequency dithering noise insertion during the synthesis and provides frame alignment procedures during analysis and synthesis to allow both amplitude and phase manipulation during speech manipulations, e.g. pitch modification, spectral smoothing, vocal tract conversion etc. Of course, any existing speech analysis/reconstruction technique in the art can be used to implement speech analysis means 201 and speech reconstruction means 209 for the present invention, which does not form any restriction on the implementation of the present invention.

The fulfillment of functions of the voice conversion system 200 depends on two operating stages, i.e. a training stage and a conversion stage. The training stage provides necessary preparations for the operation of the conversion stage.

Although the training stage per se is not the problem addressed by the present invention, due to the novel configuration of the voice conversion system of the present invention, the training stage thereof is different from that of a conventional system. Hereinafter, a brief and exemplary description will be given to the training stage of the voice conversion system 200 according to an embodiment of the present invention, so that those skilled in the art will better understand the embodiment of the present invention.

The training stage of the voice conversion system 200 according to an embodiment of the present invention can be divided into three parts: 1. training of frequency warping function for spectral conversion means 202; 2. training of codebook for the target speech corpus 204 and unit selection means 205; 3. besides these two main parts, additional training can also be included, such as prosodic parameter training, average spectrum training, etc.

1. Training of Frequency Warping Function

As discussed above, spectral conversion means 202 can use frequency warping technologies to perform spectral conversion on the spectrum envelope of the source speech.

Frequency warping is able to compensate for the differences between the acoustic spectra of different speakers. Given a spectral cross section of one sound, a new spectral cross section is created by applying a frequency warping function. Suppose one frame of the source speaker's spectrum is S(w) and the frequency warping function from the target frequency axis to the source frequency axis is F(w), then the converted spectrum Conv(w) is:

$$\mathrm{Conv}(w)=S(F(w))$$

In the prior art there are many automatic training methods for finding good-performance frequency warping functions. One is a maximum likelihood linear regression method. Please refer to L. F. Uebeland and P. C. Woodland, "An investigation into vocal tract length normalization," EUROSPEEECH' 99, Budapest, Hungary, 1999, pp. 2527-2530. However, this method requires a large training dataset, which limits its usage scenarios. Eichner, M., M. Wolff, and R. Hoffmann, "Voice Characteristics Conversion for TTS Using Reverse VTLN," Proc. ICASSP, Montreal, PQ, Canada, 2004 proposed to select the frequency warping function from some pre-defined one-parameter families of functions, but the effectiveness is not satisfying. David Sundermann and Hermann Ney, "VTLN-Based Voice Conversion," ICSLP, 2004, Jeju, Korea, 2004, adopted dynamic programming to train linear or piecewise linear warping functions, which minimizes the distance between the converted source spectrum and the target one. However, this method can be greatly degraded by noise in the input spectra.

Another method was proposed by Eide, E. and H. Gish in "A Parametric Approach to Vocal Tract Length Normalization," in ICASSP 1996, Atlanta, USA, 1996, in which the warping function is based on the median of the third formant for each speaker. Some researchers extended this method by generating warping functions based on the formants belong to the same phoneme. However, formant frequency and its relationship with vocal tract length (VTL) are highly dependent on the context in addition to the shape of speaker's vocal tract and various phonemes, and formants for the same speaker could vary largely with different context. The Chinese Patent Application with a publication number of CN101004911A, which was filed by the same applicant, discloses a novel solution of generating a frequency warping function by mapping formant parameters of the source speaker and the target speaker, the disclosure of which is entirely incorporated herein by reference. In this technical solution, alignment and selection processes are added to ensure the selected mapping formants can represent the difference between speakers' phonation well. Then, the mapping formants will be the key positions to define a piecewise linear frequency warping function from the target frequency axis to the source frequency axis. Linear interpolation is proposed to generate the part between two adjacent key positions while other interpolation solutions may also be used. This solution needs only a very small amount of training data to generate training data of the warping function, which can greatly facilitate its application, achieve relatively high quality of the converted speech, and successfully make the converted speech be similar to the target speaker.

2. Training of Codebook

The target corpus 204 can store and provide a codebook for unit selection means 205. A codebook is composed of many code words. Usually one code word is generated from one frame of speech data, such as 10 ms speech data. One code word can also be used to reconstruct one frame of speech data.

Basically, there are two types of code words. One is without phonetic information, which means each code word will only contain acoustic information such as spectrum and fundamental frequency. The other is with phonetic information, which means besides acoustic information each code word contains phonetic information such as the phoneme that code word belongs to, neighboring phonemes, etc.

To generate a codebook without phonetic information is usually very simple, which just needs to make speech analysis of the speech data by frame, and gets spectrum envelope and fundamental frequency of each frame. Then some frames are selected from all analyzed frames. The selection can be made by simply selecting one in a fixed interval. Of course, the selection can be made with some more complex strategies. For example, fewer frames can be selected in those silence or low energy sections. Or more frames can be selected in more rapidly changing sections while selecting fewer frames in stable sections.

To generate a codebook with phonetic information, alignment information is usually needed. Alignment can be made by an automatic speech recognition engine, which will align the speech data in the target speech corpus 204 with corresponding units, such as syllables, phonemes, etc. The alignment can also be labeled manually by listening to speech data in the target speech corpus 204. With the alignment information, many kinds of phonetic information for one code word will be obtained, such as the phoneme it belongs to, the position in the phoneme and its neighboring phoneme, etc. Such phonetic information can be very useful for the selection of codebook units made by unit selection means 205 during the conversion stage.

3. Other Training

Besides these two parts above, additional training can also be included, i.e. prosodic parameter (pitch parameter) training, spectrum equalization filter training, etc.

Prosodic training is to provide for prosodic conversion means 203 the prosodic conversion function for the conversion from the source speaker's pitch to the target speaker's pitch. Fundamental frequency ($f_0$) conversion is essential to prosodic conversion. $f_0$ contours can be adjusted with a linear transform applied to log $f_0$. Thus, if $f_{0s}$ is the source $f_0$ and $f_{0t}$ is the target $f_0$, then $\log f_{0t}=a+b \log f_{0s}$, where a and b are chosen to transform the average and variance of log $f_0$ of the source speaker to those of the target speaker. So we can generate the $f_0$ conversion function by calculating the average and variance of log $f_0$ of the source speaker and the target speaker.

Spectral-envelope equalization is implemented as a filter (not shown) on the spectrum to compensate for the different energy distribution along the frequency axis. Spectrum equalization filter needs to be trained, because the difference curve between average power spectra of the source and target speakers is calculated after frequency warping. Then, the difference curve is smoothed to get a smoother spectral filter serving as the spectral envelope equalization filter.

Of course, those skilled in the art will appreciate that any other processing means which are not described here but can be known based on the prior art can be included to the voice conversion system 200 according to the present invention in order to achieve better results of speech conversion. Therefore, other additional training steps for these additional processing means can be included herein.

When the voice conversion system 200 according to an embodiment of the present invention implements the conversion from the source speech to the target speech, the system enters the conversion stage.

First, speech analysis means 201 performs speech analysis for the source speaker's speech to obtain spectrum envelope and pitch contour information.

Spectral conversion means 202 applies spectral conversion on the spectrum envelope of the source speaker's speech. As described previously, in this embodiment, spectral conversion means 202 applies the frequency warping frequency obtained in the training stage on the spectrum envelope of the source speaker's speech to obtain the first spectrum similar to the target speaker's speech.

Prosodic conversion means 203 performs prosodic conversion on pitch contour, which mainly includes fundamental frequency ($f_0$) contour conversion. For example, the $f_0$ contour is converted by the $f_0$ conversion function trained in the training stage. Afterwards, prosodic conversion means 203 provides the converted pitch information for unit selection means 205 and speech reconstruction means 209 for subsequent usage.

Through the conversion implemented by spectral conversion means 202 and prosodic conversion means 203, the first spectrum is more similar to the target speaker's spectrum, and preferably, the converted pitch contour is more similar to that target speaker's pitch contour.

Unit selection means 205 makes unit selection on the codebook obtained by the target speech corpus 204 during the previous training process at least using the first spectrum as the estimated target. In this embodiment, unit selection means 205 preferably uses the first spectrum converted with frequency warping and the converted $f_0$ contour as the estimated target to select appropriate code words from the codebook obtained by the target speech corpus 204 during the previous training process.

Unit selection means 205 performs a processing similar to candidate unit selection in a concatenative text-to-speech system. However, the difference is that the present invention uses the converted first spectrum and the converted $f_0$ contour as the target of the unit selection. Such an estimated target is much more natural than that estimated by a prosody model and other models in TTS systems. Unit selection means 205 can generate a set of target code words based on the converted first spectrum and the converted $f_0$ contour. Then, the target cost function between the target code word and the candidate code word can be defined. Preferably, this target cost can be a weighted sum of spectral distance, prosodic distance and phonetic distance. Besides the target cost, unit selection means 205 further needs to define the transition cost between two candidate code words. This transition cost can also be a weighted sum of spectral distance, prosodic distance and phonetic distance, which is similar to the target cost. Thus, unit selection means 205 determines from the codebook generated in the target speech corpus 204 the set of code words which match the converted first spectrum and the converted $f_0$ contour most.

Next, spectrum replacement means 206 replaces at least one part of the first spectrum with the real spectrum of the selected speech unit of the target speaker. Since the target speaker's speech is selected in a basic unit such as frame, it is likely to raise a severe discontinuity problem in the ultimately obtained speech if spectrum replacement means 206 replaces the whole spectrum corresponding to this unit in the first spectrum with the selected unit directly. Since the low frequency part of spectrum is very essential to the continuity and not so important for improving the similarity to target, according to a preferred solution of the present invention, spectrum replacement means 206 keeps the low frequency part of spectrum corresponding to the selected unit in the first spectrum unchanged. That is to say, after the appropriate code word is selected, spectrum replacement means 206 replaces a part of the first spectrum higher than a specific frequency with the corresponding spectrum of the selected code word and keeps the part lower than the specific frequency of the first spectrum unchanged. According to a preferred implementation solution of the present invention, the specific frequency is selected from 500 Hz to 2000 Hz.

Preferably, spectrum smoothing means 208 smoothes the spectrum obtained from the replacement using any known solution in the prior art.

Speech reconstruction means 209 reconstructs the speech data from the smoothed spectrum and the converted $f_0$ contour, whereby the converted speech is obtained finally.

Compared with the existing voice conversion system with frequency warping, the voice conversion system according to an embodiment of the present invention as shown in FIG. 2 obtains the finally converted speech that shows about 20% improvement in similarity to the target speaker with an acceptable degradation in quality.

Some components of the voice conversion system shown in FIG. 2 are optional to the present invention, such as spectrum smoothing means 208 that functions to eliminate tiny spur and transition of spectrum envelop for speech reconstruction, make the spectrum envelop smoother and finally achieve the converted speech with better performance. On the other hand, those skilled in the art may add other components not shown in the embodiment of FIG. 2 when carrying out the voice conversion system according to the present invention, so as to further improve the performance of the finally converted speech, e.g. for eliminating additional noise, or for achieving special sound effect.

Figure 3:
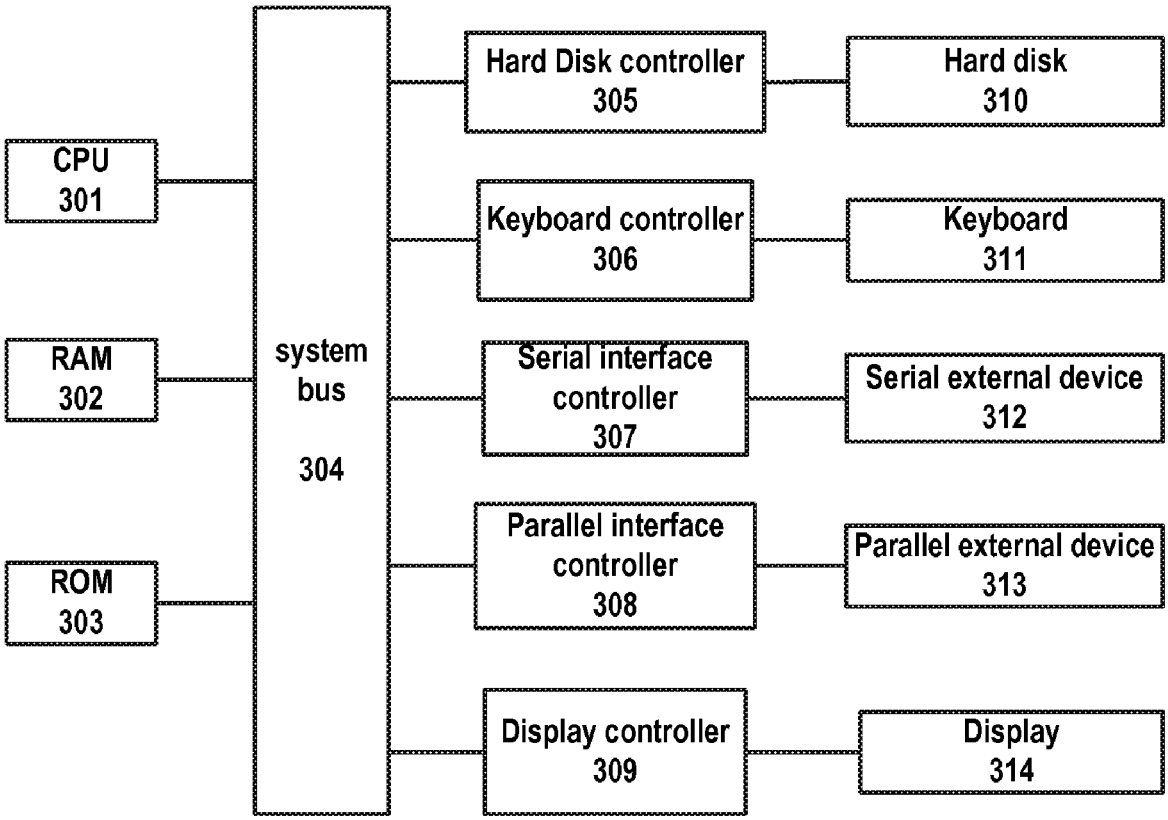
FIG. 3 schematically shows a computer device in which embodiments according to the present invention can be implemented.

FIG. 3 schematically shows a computing device in which the embodiments according to the present invention may be implemented.

The computer system shown in FIG. 3 comprises a CPU (Central Processing Unit) 301, a RAM (Random Access Memory) 302, a ROM (Read Only Memory) 303, a system bus 304, a Hard Disk controller 305, a keyboard controller 306, a serial interface controller 307, a parallel interface controller 308, a display controller 309, a hard disk 310, a keyboard 311, a serial external device 312, a parallel external device 313 and a display 314. Among these components, connected to system bus 304 are CPU 301, RAM 302, ROM 303, HD controller 305, keyboard controller 306, serial interface controller 307, parallel interface controller 308 and display controller 309. Hard disk 310 is connected to HD controller 305, and keyboard 311 to keyboard controller 306, serial external device 312 to serial interface controller 307, parallel external device 313 to parallel interface controller 308, and display 314 to display controller 309.

The functions of each component in FIG. 3 are well known in the art, and the architecture shown in FIG. 3 is conventional. Such architecture applies to not only personal computers but also hand held devices such as Palm PCs, PDAs (personal data assistants), mobile telephones, etc. In different applications, some components may be added to the architecture shown in FIG. 3, or some of the components shown in FIG. 3 may be omitted. The whole system shown in FIG. 3 is controlled by computer readable instructions, which are usually stored as software in hard disk 310, EPROM or other non-volatile memory. The software can also be downloaded from the network (not shown in the figure). The software, either saved in hard disk 310 or downloaded from the network, can be loaded into RAM 302, and executed by CPU 301 for implementing the functions defined by the software.

As the computer system shown in FIG. 3 is able to support the voice conversion solution according to the present invention, the computer system merely serves as an example of computer systems. Those skilled in the art may understand that many other computer system designs are also able to carry out the embodiments of the present invention.

The present invention may further be implemented as a computer program product used by, for example the computer system shown in FIG. 3, which contains code for implementing the voice conversion method according to the present invention. The code may be stored in a memory of other computer system prior to the usage. For instance, the code may be stored in a hard disk or a removable memory like an optical disk or a floppy disk, or may be downloaded via the Internet or other computer network.

As the embodiments of the present invention have been described with reference to the accompanying drawings, various modifications or alterations may be made by those skilled in the art within the scope as defined by the appended claims.

That which is claimed is:

1. A voice conversion method comprising:

performing speech analysis on speech of a source speaker to attain speech information comprising a first spectrum;

converting the first spectrum to a second spectrum, wherein converting the first spectrum to the second spectrum comprises compensating for at least one spectral difference between the speech of the source speaker and speech of a target speaker;

in response to converting the first spectrum to the second spectrum, generating a third spectrum, wherein generating the third spectrum comprises selecting, based on at least the second spectrum, at least one speech unit from a corpus comprising a plurality of speech units of the target speaker;

generating a replaced spectrum by replacing at least part of the second spectrum with at least part of the third spectrum; and performing speech reconstruction based at least on the replaced spectrum.

2. The method according to claim 1, wherein converting the first spectrum to the second spectrum comprises frequency warping.

3. The method according to claim 1, wherein the speech information further comprises a first pitch contour, wherein the method further comprises:

converting the first pitch contour to a second pitch contour, wherein converting the first pitch contour comprises compensating for at least one pitch difference between the speech of the source speaker and the speech of the target speaker;

wherein selecting the at least one speech unit from the corpus is based on at least the second spectrum and the second pitch contour; and wherein performing the speech reconstruction is based at least on the replaced spectrum and the second pitch contour.

4. The method according to claim 1, wherein generating the replaced spectrum comprises:

replacing a part of said second spectrum higher than a specific frequency with the at least part of the third spectrum; and keeping a part of said second spectrum lower than said specific frequency unchanged.

5. The method according to claim 4, wherein said specific frequency is between 500 Hz and 2000 Hz.

6. The method according to claim 1, further comprising:

smoothing the replaced spectrum before performing the speech reconstruction.

7. The method according to claim 1, wherein said speech information comprises pitch contour information.

8. The method of claim 1, wherein generating the replaced spectrum involves replacing only part of the second spectrum with the at least part of the third spectrum.

9. A voice conversion system comprising:

speech analysis means for performing speech analysis on speech of a source speaker to attain speech information comprising a first spectrum;

spectral conversion means for converting the first spectrum to a second spectrum, wherein converting the first spectrum to the second spectrum comprises compensating for at least one spectral difference between the speech of the source speaker and speech of a target speaker;

unit selection means for, in response to the converting of the first spectrum to the second spectrum, generating a third spectrum, wherein generating the third spectrum comprises selecting, based on at least the second spectrum, at least one speech unit from a corpus comprising a plurality of speech units of the target speaker;

spectrum replacement means for generating a replaced spectrum by replacing at least part of said second spectrum with at least part of the third spectrum; and speech reconstruction means for performing speech reconstruction based at least on the replaced spectrum.

10. The system according to claim 9, wherein said spectral conversion means converts the first spectrum to the second spectrum using at least frequency warping.

11. The system according to claim 9, wherein the speech information further comprises a first pitch contour, the system further comprising:

prosodic conversion means for converting the first pitch contour to a second pitch contour, wherein converting the first pitch contour comprises compensating for at least one pitch difference between the speech of the source speaker and the speech of the target speaker;

wherein said unit selection means selects the at least one speech unit from the corpus based at least on the second spectrum and the second pitch contour; and wherein said speech reconstruction means performs speech reconstruction based at least on the replaced spectrum and the second pitch contour.

12. The system according to claim 9, wherein said spectrum replacement means:

replaces a part of said second spectrum higher than a specific frequency with the at least part of the third spectrum; and keeps a part of said second spectrum lower than said specific frequency unchanged.

13. The system according to claim 12, wherein said specific frequency is between 500 Hz and 2000 Hz.

14. The system according to claim 9, further comprising:

spectrum smoothing means for smoothing the replaced spectrum to generate a smoothed replaced spectrum; and wherein said speech reconstruction means performs speech reconstruction based on the smoothed replaced spectrum.

15. The system according to claim 9, wherein said speech information comprises pitch contour information.

16. The system according to claim 9, wherein the spectrum replacement means replaces only part of the second spectrum with the at least part of the third spectrum.

17. A computer readable storage device comprising computer readable instructions which, when executed by at least one processor, cause performance of a voice conversion method comprising:

performing speech analysis on speech of a source speaker to attain speech information comprising a first spectrum;

converting the first spectrum to a second spectrum, wherein converting the first spectrum to the second spectrum comprises compensating for at least one spectral difference between the speech of the source speaker and speech of a target speaker;

in response to converting the first spectrum to the second spectrum, generating a third spectrum, wherein generating the third spectrum comprises selecting, based on at least the second spectrum, at least one speech unit from a corpus comprising a plurality of speech units of the target speaker;

generating a replaced spectrum by replacing at least part of the second spectrum with at least part of the third spectrum; and performing speech reconstruction based at least on the replaced spectrum.

18. The computer readable storage device of claim 17, wherein converting the first spectrum to the second spectrum comprises frequency warping.

19. The computer readable storage device of claim 17, wherein the speech information further comprises a first pitch contour, wherein the method further comprises:

converting the first pitch contour to a second pitch contour, wherein converting the first pitch contour comprises compensating for at least one pitch difference between the speech of the source speaker and the speech of the target speaker;

wherein selecting the at least one speech unit from the corpus is based on at least the second spectrum and the second pitch contour; and wherein performing the speech reconstruction is based at least on the replaced spectrum and the second pitch contour.

20. The computer readable storage device of claim 17, wherein generating the replaced spectrum comprises:

replacing a part of said second spectrum higher than a specific frequency with the at least part of the third spectrum; and keeping a part of said second spectrum lower than said specific frequency unchanged.

21. The computer readable storage device of claim 20, wherein said specific frequency is between 500 Hz and 2000 Hz.

22. The computer readable storage device of claim 17, wherein the method further comprises:

smoothing the replaced spectrum before performing the speech reconstruction.

23. The computer readable storage device of claim 17, wherein said speech information comprises pitch contour information.

24. A voice conversion system comprising:

a speech analyzer configured to perform speech analysis on speech of a source speaker to attain speech information comprising a first spectrum;

a spectral converter configured to convert the first spectrum to a second spectrum, wherein converting the first spectrum to the second spectrum comprises compensating for at least one spectral difference between the speech of the source speaker and speech of a target speaker;

a unit selector configured to, in response to conversion of the first spectrum to the second spectrum, generate a third spectrum, wherein generating the third spectrum comprises selecting, based on at least the second spectrum, at least one speech unit from a corpus comprising a plurality of speech units of the target speaker;

a spectrum generator configured to generate a replaced spectrum by replacing at least part of said second spectrum with at least part of the third spectrum; and a speech reconstructor configured to perform speech reconstruction based at least on the replaced spectrum.

25. The system according to claim 24, wherein said spectral converter is configured to convert the first spectrum to the second spectrum using at least frequency warping.

26. The system according to claim 24, wherein the speech information further comprises a first pitch contour, the system further comprising:

a prosodic converter configured to convert the first pitch contour to a second pitch contour, wherein converting the first pitch contour comprises compensating for at least one pitch difference between the speech of the source speaker and the speech of the target speaker;

wherein said unit selector selects the at least one speech unit from the corpus based at least on the second spectrum and the second pitch contour; and wherein said speech reconstructor performs speech reconstruction based at least on the replaced spectrum and the second pitch contour.

27. The system according to claim 24, wherein said spectrum generator is configured to:

replace a part of said second spectrum higher than a specific frequency with the at least part of the third spectrum; and keep a part of said second spectrum lower than said specific frequency unchanged.

28. The system according to claim 27, wherein said specific frequency is between 500 Hz and 2000 Hz.

29. The system according to claim 24, further comprising:

a spectrum smoother configured to smooth the replaced spectrum to create a smoothed replaced spectrum; and wherein said speech reconstructor performs speech reconstruction based on the smoothed replaced spectrum.

30. The system according to claim 24, wherein said speech information comprises pitch contour information.

31. The voice conversion system of claim 24, wherein the spectrum generator is configured to replace only part of the second spectrum with the at least part of the third spectrum.

* * * * *